US005924942A

United States Patent [19]

Gentile

[11] Patent Number: 5,924,942

[45] Date of Patent: Jul. 20, 1999

[54] GAME BALL

[76] Inventor: Robert Gentile, 30 Wyman Rd., Billerica, Mass. 01821

[21] Appl. No.: 08/944,880

[22] Filed: Oct. 6, 1997

[51] Int. Cl.[6] ..... A63H 3/52; A63H 23/08; A63H 33/26

[52] U.S. Cl. ..... 473/570; 473/594; 473/596; 446/267; 446/485

[58] Field of Search ..... 473/570, 571, 473/594, 595, 596, 609, 593, 603, 613; 446/267, 485

[56] References Cited

U.S. PATENT DOCUMENTS

| | | | |
|---|---|---|---|
| 2,020,484 | 11/1935 | Turner | 473/570 |
| 2,301,506 | 11/1942 | Bean | 473/594 |
| 2,645,486 | 7/1953 | Monahan | 473/594 |
| 2,670,206 | 2/1954 | Brewster . | |
| 3,580,575 | 5/1971 | Speeth | 473/570 |
| 3,804,411 | 4/1974 | Hendry | 473/570 |
| 4,448,418 | 5/1984 | McNeill . | |
| 4,872,676 | 10/1989 | Townsend . | |
| 5,066,011 | 11/1991 | Dykstra et al. . | |
| 5,236,383 | 8/1993 | Connelly . | |
| 5,285,586 | 2/1994 | Goldston et al. . | |
| 5,408,764 | 4/1995 | Wut . | |
| 5,516,098 | 5/1996 | Aiello . | |
| 5,518,234 | 5/1996 | Palmquist | 473/596 |
| 5,564,702 | 10/1996 | Meffert | 473/570 |
| 5,639,076 | 6/1997 | Cmiel et al. | 473/570 |
| 5,725,445 | 3/1998 | Kennedy et al. | 473/570 |

*Primary Examiner*—Steven Wong
*Attorney, Agent, or Firm*—O'Connell Law Firm

[57] ABSTRACT

A game ball has a hollow spherical shell with at least a portion thereof that is translucent. A plurality of dimples are disposed on the outer surface of the hollow shell. At least some of the dimples comprise double concave negative lenses with a convex portion generally concentric with an outer concave surface of the double concave negative lenses. An impact triggering mechanism, a power source, and a light source are contained within a bulb that is contained within an open inner volume of the hollow shell. Upon impact of the game ball with an outside body, the impact triggering mechanism sends power from the power source to energize the light source. Light is emitted and refracted through the lenses whereby the game ball tends to glow and attention is attracted to the game ball. A volume of liquid is contained within the open inner volume of the hollow shell for dampening energy and protecting the bulb.

16 Claims, 3 Drawing Sheets

GAME BALL

FIELD OF THE INVENTION

The present invention relates generally to game balls. More particularly, it relates to a game ball that emits a flash of light with each collision of the ball with an outside body.

BACKGROUND OF THE INVENTION

Obviously, many species of balls are known to the art. Since each application in which balls are used presents a potentially unique set of demands, inventors have developed technology relevant to a wide variety of useful balls. Some balls are adapted for particular sports while others are useful in industrial applications.

As one might expect, with street hockey increasing in popularity, there has been a concomitant development of street hockey ball technology. Material adaptations to prior art balls have been enacted to reduce bounce and to improve durability. Also, liquids have been inserted into street hockey balls to reduce their bounce and to improve their control (e.g., see this inventor's application Ser. No. 08/538,032 for a Game Ball, which is hereby incorporated herein by reference). Still further, repeatedly flashing lights have been included to draw attention to a ball that is in play. Undoubtedly, further improvements relative to street hockey balls are inevitable.

One seeking to invent in this area must consider the needs presented by such an application. Of course, the ball should be within standard size and weight specifications. Clearly, the ball must be durable. Ideally, the ball will demonstrate very little bounce but will exhibit good aerodynamic lift coupled with low aerodynamic drag. Still further, a preferred ball would effectively draw a player's attention both to itself and to the moment that it is struck each time a player hits the ball or the ball hits another object or surface.

Surely a game ball that met one of the aforementioned needs would be useful. However, a ball meeting all of the needs presented by the street hockey application would represent a marked advance in the art.

SUMMARY OF THE INVENTION

Advantageously, the present invention provides a game ball that meets each of the previously-described needs that were left by the prior art. In meeting these needs, one embodiment of the invention essentially comprises a game ball for street hockey with a spherical hollow shell and a light source contained within an open inner volume of the hollow shell. A power source is operably associated with the light source as is a triggering mechanism for selectively activating the light source in response to an impact upon the hollow shell. At least a portion of the hollow shell is translucent whereby light emitted from the light source can pass through the hollow shell to the environment of the game ball. In presently preferred embodiments, the triggering mechanism activates the light source to emit a single, brief flash upon the ball's colliding with an outside body whereby attention is called to the game ball immediately and only upon the ball's being struck or striking a surface.

Since one important object of the present invention is to provide a ball that exhibits reduced bounce as compared to balls of the prior art, one important feature of the present game ball is the inclusion of a volume of relatively low viscosity liquid within the open inner volume of the hollow shell. This volume of liquid has been discovered to dampen undesirable bouncing. As a result, the ball is safer and easier to control and hit. Although a wide variety of liquids would be effective, the inventor has found that one preferred liquid solution comprises mineral oil with liquid silicone and a volume of water-based saline solution.

The inventor has discovered that further advantage may be realized by not fixedly coupling the light source to the hollow shell and by forming the hollow shell with a smooth, unobstructed, and spherical inner surface. With this, the light sources is free to move about the open inner volume of the hollow shell with the volume of liquid. As a result, damage to the light source deriving from collisions is rendered less likely because the volume of liquid tends to act as a dampening cushion between the light source and the inner surface of the hollow shell.

As was alluded to above, one primary object of the invention is to draw attention to the game ball when the game ball collides with an outside body such as when the ball is hit by a hockey stick. With this object in mind, the inventor was presented with arguably competing concerns. Although he desired to draw the greatest attention to the ball that was possible, he also sought to keep the light source simple, compact, and conservative in power consumption. A light source too large would not fit within the open inner volume of the game ball, a light source too complex would be unduly expensive; and a light source requiring too much power would have an unacceptably short lifespan. With these things in mind, the inventor realized that making optimal use of any given flashing light source was imperative. To do so, he devised of locating at least one lens device in the hollow shell of the game ball for refracting and thereby manipulating light emitted from the light source. Ideally there will be a plurality of lenses distributed over the hollow shell. The lenses may be negative lenses such as double concave negative lenses whereby light passing through the lenses exhibits a divergent refraction. With such lenses scattered over the hollow shell of the game ball, the game ball will exhibit an attention-demanding glow each time the light source is activated. A convex lens may be included generally concentric with the exterior surface of the double concave negative lens whereby light passing through the lenses exhibits a divergent refraction at its periphery while exhibiting a convergent refraction at its mid-portion. With this, each time the ball experienced a collision, it would present a glowing orb with intense bright spots scattered thereover.

Another important aspect of the present invention relates to the street hockey ball's dual aerodynamic objects of reducing drag upon the ball while enhancing lift demonstrated by the ball as the game ball moves through air. To achieve these objects, the inventor has conceived of modifying prior art street hockey balls to have a surface pattern such as a plurality of dimples scattered over the outer surface of the ball's hollow shell. The dimples provide lift to the ball. As the ball spins off a hockey stick, the tiny cups trap air and cause the air to move more quickly over the top of the ball than around the bottom. This manipulation of air movement induces aerodynamic lift, a pressure differential between the top and bottom of the ball that tends to resist the downward pull of gravity. The dimples also tend to reduce aerodynamic resistance or drag on the ball. For reasons that must be considered beyond the necessary scope of the present discussion, the surface pattern induces a more laminar air flow around the ball that allows the ball to pass through air more easily than would otherwise be possible. These combined advantages that derive from the dimple pattern allow the street hockey ball to fly faster and farther than prior art street hockey balls that do not possess an aerodynamically significant surface pattern such as the surface dimples.

The foregoing discussion broadly outlines the more important features of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

BRIEF DESCRIPTION OF THE DRAWINGS

In the accompanying drawings.

DETAILED DESCRIPTION OF THE PREFERRED EMBODIMENT

Figure 1:
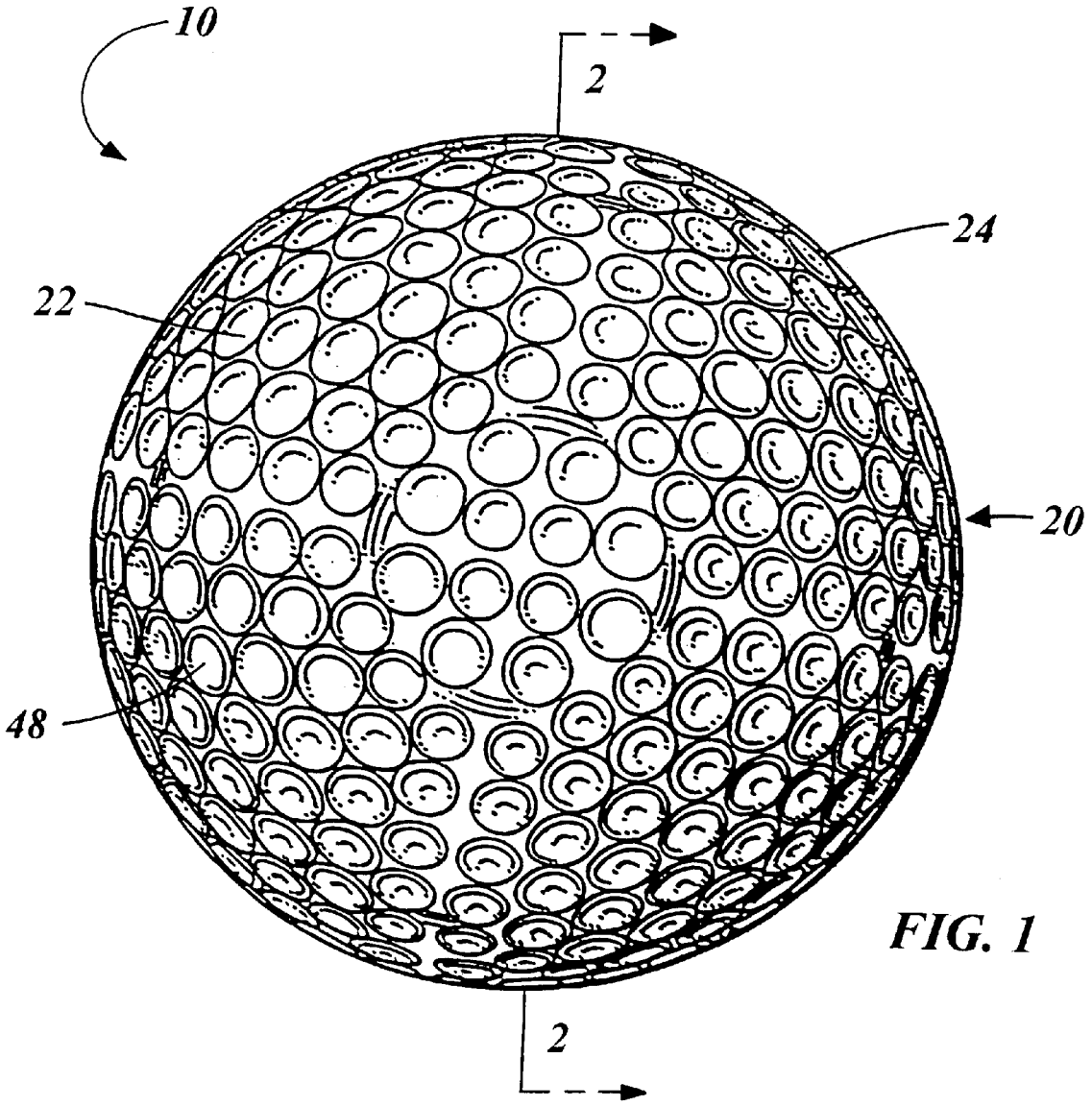
FIG. 1 is a view in front elevation of a game ball according to the present invention.

Referring more particularly to the drawings, one sees that a game ball 10 according to the present invention is shown in FIG. 1. FIG. 2 again illustrates the game ball 10 but in a cross-sectional view. In this preferred embodiment, the game ball 10 is adapted particularly for street hockey. As such, the preferred game ball 10 is constructed to be of appropriate dimension and material for such an application. This embodiment of the game ball 10 has a hollow shell, which is indicated generally at 20, that may be formed from a plastic, an elastomer, or any other suitably tough and resiliently-deformable material. The inventor has determined that a composition of 50% plasticizer, 40% poly-vinyl chloride, and 10% urethane appears to be ideal.

The hollow shell 20 has an open inner volume 24 enclosed therein. In this preferred embodiment, the hollow shell 20 may have an outside diameter that is between about 2 inches and 3 inches, but approximately 2.597 inches is preferred. The preferred embodiment's hollow shell 20 may have a wall thickness between about 0.1 inches and 0.2 inches with 0.134 or 0.147 inches preferred. Of course, other materials and dimensions alternatively may be acceptable or preferable, particularly in applications other than street hockey.

Figure 2:
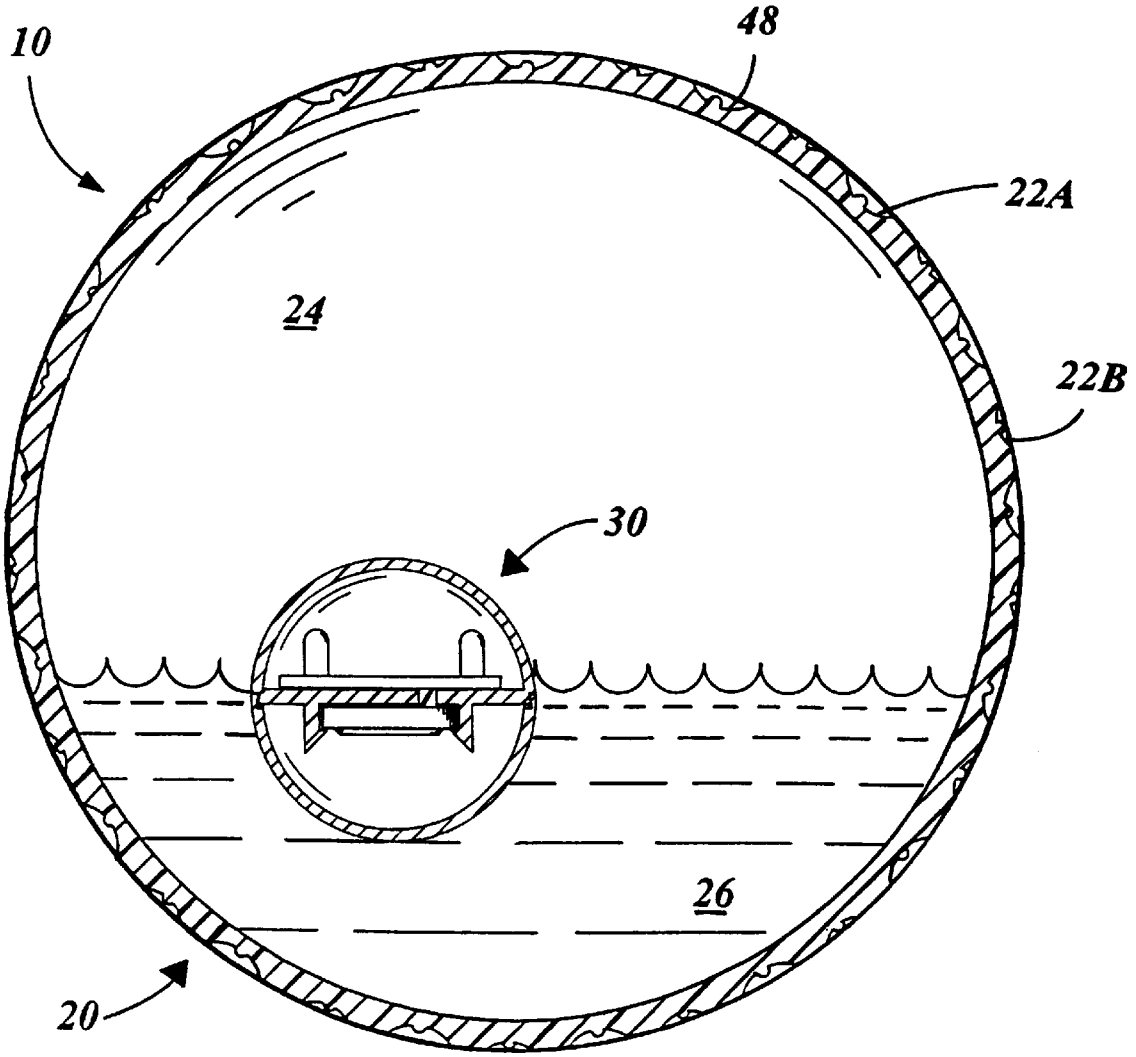
FIG. 2 is a cross-sectional view of the game ball of FIG. 1 taken along the line 2—2.
Figure 3:
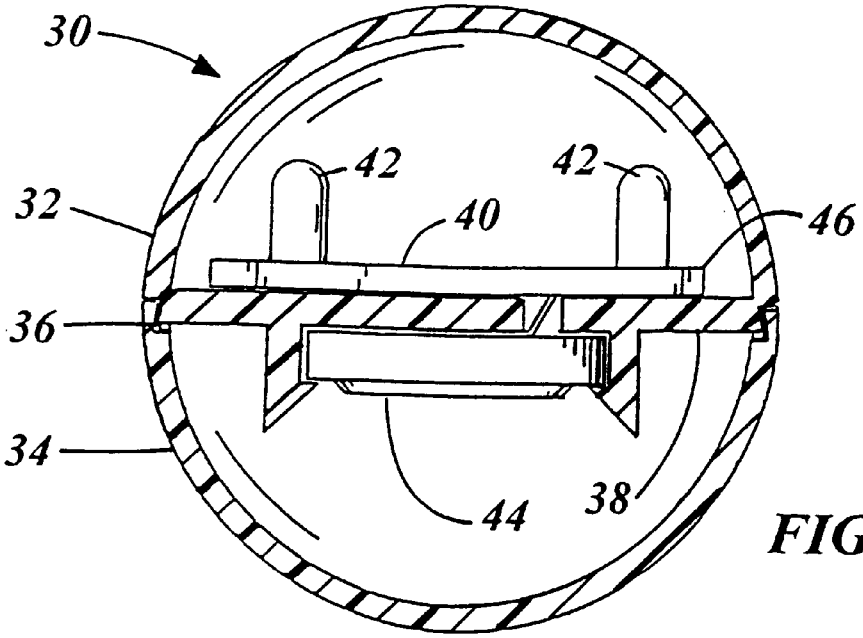
FIG. 3 is an enlarged cross-sectional view of the bulb unit of FIG. 2.

As FIG. 1 shows most clearly, the outer surface of the hollow shell 20 has an aerodynamic surface pattern 22 thereon in the form of a multiplicity of dimples, also referred to at 22, spread over the entire outer surface 24 of the hollow shell 20. Since its purpose is to enhance aerodynamic lift and to reduce aerodynamic drag on the game ball 10, the surface pattern 22 must be sufficiently significant that it will affect air flow over the outer surface 24 of the game ball 10. In this preferred embodiment, as FIG. 2 shows most clearly, the dimples 22 are formed in two sizes. Large dimples 22A are approximately 0.144 inches in diameter, and small dimples 22B are approximately 0.113 inches in diameter. Both size dimples 22A and 22B are approximately 0.003 inches in depth.

Retained within the open inner volume 24 is a volume of liquid 26. One of the primary purposes of the volume of liquid 26 is to dampen energy thereby reducing undesirable bouncing of the game ball 10. Therefore, the volume of liquid 26 may comprise substantially any liquid although relatively low viscosity liquids may dampen energy most effectively. Nonetheless, one may note that certain low viscosity liquids probably are less desirable while others may be preferred. For example, water probably is not optimal because it can freeze. However, non-toxic antifreeze such as propylene glycol antifreeze has been found to work well. Furthermore, the inventor has found that a solution of mineral oil, liquid silicone, and saline solution also works well.

A bulb 30 floats freely in the volume of liquid 26 within the hollow shell 20 and is not fixedly coupled to the hollow shell 20. Ideally, the combined weight of the bulb 30 and the liquid 26 is approximately 35 grams. The bulb 30 is generally waterproof and is formed by the snap coupling of a first half 32 with a second half 34. In this preferred embodiment, the first half 32 and the second half 34 are formed from clear plastic. To ensure the waterproof nature of the bulb 30, an annular rubber O-ring 36 is located to create a sealing connection between the first half 32 and the second half 34 of the bulb 30. Of course, it should be made clear that the bulb 30 and its contents are given as an example of a means by which the game ball 10 can emit a flash upon collision with an outside object. Of course, other means for accomplishing such a task will be obvious to one skilled in the art who reads the present disclosure.

In any event, it this embodiment the first half 32 of the bulb 30 has a platform 38 spanning its lower portion. A printed circuit board 40 is mounted to the platform 38. A pair of light emitting diodes (LEDs) 42 are fixed to the printed circuit board 40 and are operated by the circuitry of the printed circuit board 40. The LEDs 42 function as a light source for the game ball 10. A battery 44 is mounted on the opposite side of the platform 38. The battery 44 functions as a power source for driving the LEDs 42 in response to an impact triggering mechanism 46, which is incorporated into the printed circuit board 40 and which may be of any of the designs known to the art. For example, U.S. Pat. No. 5,066,011 for a Flashing Light Ball, U.S. Pat. No. 5,236,383 for a Illuminated Toy Ball, and U.S. Pat. No. 5,408,764 for a Motion Activated Illuminating Footwear and Light Module Therefor each provide useful reference material, and each is expressly incorporated herein by reference.

Under this arrangement, power is sent from the battery 44 to the LEDs 42 in response to an impact upon the game ball 10. It is worth noting that the inventor has found it to be most preferable that the light source or LEDs 42 be energized just one time and for an extremely brief time period (i.e., one millisecond) in response to each impact. Repeated flashes or unduly long flashes have been discovered to detract from the invention's object of attracting attention to the game ball 10 each time the game ball 10 collides with an outside object.

Obviously, for the game ball 10 to accomplish its states objective of drawing attention to itself upon impact, all or at least a portion of the outer shell 20 must be translucent or transparent to allow light emitted from the LEDs 42 to pass to the environment of the game ball 10. Naturally, the entire outer shell 20 may be translucent. However, the inventor has devised of a means for causing light emitted from the LEDs 42 to draw attention to the game ball 20 more effectively than would a merely translucent ball. This means comprises a plurality of lenses 48 interposed with the outer shell 20 of the game ball 10 for refracting light emitted from the LEDs 42 in a manner designed to make most advantageous usage of the supplied light.

Figure 4:
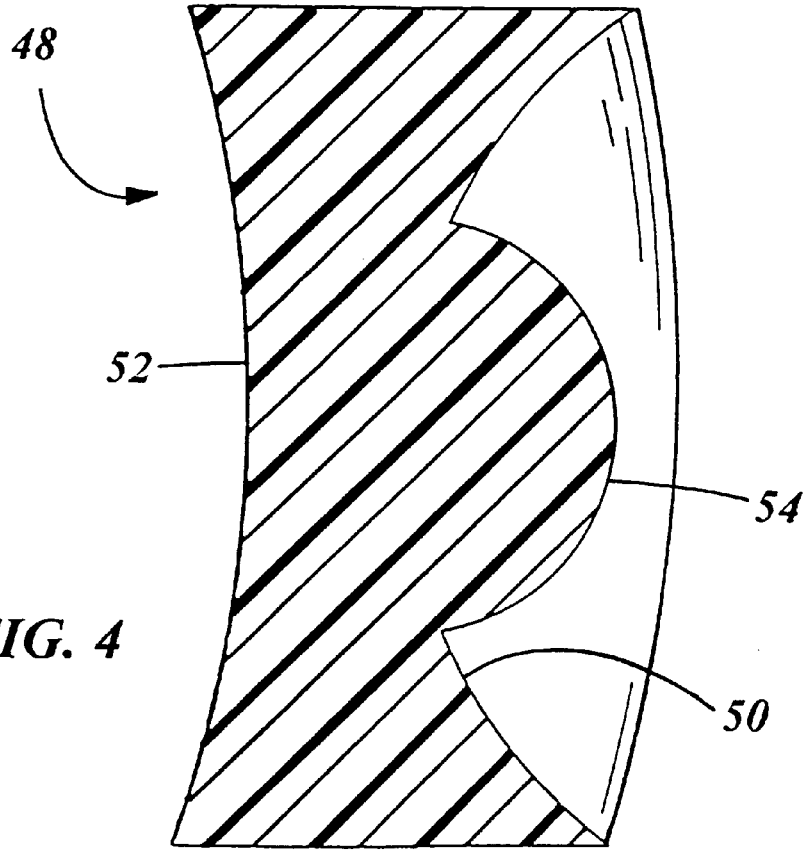
FIG. 4 is an enlarged cross-sectional view of a preferred lens design.

The inventor theorized that each lens 48 may be designed to cause light to diverge upon passing through the hollow shell 20 of the game ball 10. With such a divergence, the game ball 10 will tend to glow as the lenses 48 have diverged the emitted light into a surrounding ball of light. The inventor further theorized that still greater attention would be attracted to the game ball 10 if the surrounding ball of light had a multiplicity of intensely bright spots interspersed throughout. The inventor realized that the desired divergence could be achieved by employing double concave negative lenses 48 so that light is diverged most effectively. Such lenses 48 are illustrated in FIG. 1 where they are coincident with, and form, the multiplicity of dimples 22. However, as is illustrated in FIGS. 2 generally and in FIG. 4 in cross section, to provide the simultaneously desired convergent refraction the inventor devised of further including a convex portion 54 in a middle portion of the concave outer surface 50 of each lens 48. In this embodiment, each convex portion 54 is generally concentric with the concave outer surface 50 of each lens 48. Of course, one may find other types of lenses 48 (i.e., planoconcave, concavo-convex, convexo-concave, planoconvex, or double convex) preferable in other circumstances. It is worth noting at this point the inventor's discovery that a liquid 26 solution comprised of mineral oil, saline solution, and liquid silicone also assists in amplifying light emitted from the LEDs 42 because the constituent liquids resist blending.

Although the lenses 48 certainly could be premanufactured and fixed in place into orifices (not shown) in the outer shell 10 of the game ball 10, it presently seems most advantageous to form the lenses 48 integrally with the remainder of the outer shell 10. Under such a method of manufacture, the general shape of the lenses 48 can be molded into the outer shell 10. Afterward, if necessary, the lenses 48 can be ground or lapped to suitable shape and smoothness for transmitting and refracting light.

One may note that forming the lenses 48 to be double concave is advantageous for at least three further reasons. The first is that, due to its general concavity, the outer surface 50 of each lens 48 is generally cup-shaped. As a result, each lens 48 effectively functions as a dimple 22 and accomplishes the dual purposes of refracting light and improving the aerodynamic characteristics of the game ball 10. A second advantage of the double concave lens shape is that the concavity of the inner surface 52 of each lens 48 can match the concavity of the inner surface 24 of the hollow shell 20. As a result, the inner surface 52 of each lens 48 automatically is in lucent communication with the LED light sources 42, and difficult manufacturing operations can be avoided. Still further, the lenses 48 tend to improve the overall structural rigidity and durability of the game ball 10.

From the foregoing, one skilled in the art will realize that the present invention for a game ball 10 achieves a multiplicity of advantages over the prior art. As a result of the dampening effects of the volume of liquid 26 that is contained within the game ball 10, the game ball 10 is easier to control and to hit because it exhibits minimal bounce. Additionally, the potential for damage to the bulb 30 is minimized by the volume of liquid's 26 acting as a shock-absorbing insulation around the bulb 30. Furthermore, the surface patter of dimples 22 achieves the invention's aerodynamic goals of improving lift while reducing drag. Still further, attention is most effectively directed to the glowing game ball 10 each time it collides with an outside body by the combined effects of the flashing LEDs 42 and the light-refracting lenses 48.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

I claim as protected by United States Letters Patent:

1. A game ball comprising:

a hollow shell with a spherical outer surface and an open inner volume wherein at least a part of the hollow shell is translucent;

a plurality of dimples disposed on the outer surface of the hollow shell;

a light source contained within the open inner volume of the hollow shell;

a power source operably associated with the light source;

an impact triggering mechanism for selectively activating the light source in response to an impact upon the hollow shell;

at least one lens with an outer surface interposed with the outer surface of the hollow shell and the at least one lens with an inner surface in lucent communication with the light source whereby light emitted from the light source is refracted by the at least one lens as the light passes beyond the outer surface of the hollow shell whereby the at least one lens comprises the part of the hollow shell that is translucent.

2. The game ball of claim 1 wherein the at least one lens comprises at least one of the plurality of dimples and wherein the at least one lens comprises a negative lens whereby light exhibits a divergent refraction upon passing through the at least one lens.

3. The game ball of claim 2 wherein the inner surface of the at least one lens is concave whereby the at least one lens is a double concave negative lens.

4. The game ball of claim 1 wherein the at least one lens comprises a concave outer surface with a convex portion generally concentric with the concave outer surface of the at least one lens whereby light passing through a middle portion of the at least one lens exhibits a convergent refraction while light passing through a peripheral portion of the at least one lens exhibits a divergent refraction.

5. The game ball of claim 1 further comprising a volume of liquid contained within the open inner volume of the hollow shell and wherein the light source is not fixedly coupled to the hollow shell whereby the light source can move freely about the open inner volume of the hollow shell within the volume of liquid.

6. A game ball comprising:

a hollow shell with a spherical outer surface and an open inner volume wherein at least a part of the shell is translucent;

a light source disposed within the open inner volume of the hollow shell;

a power source operably associated with the light source;

an impact triggering mechanism for selectively activating the light source in response to an impact upon the hollow shell; and a volume of liquid contained within the open inner volume of the hollow shell.

7. The game ball of claim 6 wherein the light source is not fixedly coupled to the hollow shell whereby the light source can move freely about the open inner volume of the hollow shell within the volume of liquid.

8. The game ball of claim 6 further comprising at least one lens with an outer surface interposed with the outer surface of the hollow shell and the at least one lens with an inner surface in lucent communication with the light source whereby light emitted from the light source is refracted by the at least one lens as the light passes beyond the outer surface of the hollow shell and whereby the at least one lens comprises the part of the hollow shell that is translucent.

9. The game ball of claim 8 wherein the inner surface of the at least one lens is concave whereby the at least one lens is a double concave negative lens.

10. The game ball of claim 8 wherein the at least one lens comprises a concave outer surface with a convex portion generally concentric with the concave outer surface of the at least one lens whereby light passing through a middle portion of the at least one lens exhibits a convergent refraction while light passing through a peripheral portion of the at least one lens exhibits a divergent refraction.

11. The game ball of claim 6 further comprising a plurality of dimples disposed on the outer surface of the shell.

12. The game ball of claim 11 wherein each of the plurality of dimples comprises a lens.

13. The game ball of claim 7 wherein the volume of liquid comprises mineral oil.

14. The game ball of claim 7 wherein the volume of liquid comprises liquid silicone.

15. The game ball of claim 13 wherein the volume of liquid further comprises liquid silicone.

16. The game ball of claim 15 wherein the volume of liquid further comprises a saline solution.

* * * * *